US006456158B1

(12) United States Patent
Giuroiu

(10) Patent No.: US 6,456,158 B1
(45) Date of Patent: Sep. 24, 2002

(54) DIGITALLY PROGRAMMABLE TRANSCONDUCTOR

(75) Inventor: Horia Giuroiu, Campbell, CA (US)

(73) Assignee: Oki America, Inc., Sunnyvale, CA (US)

( * ) Notice: Subject to any disclaimer, the term of this patent is extended or adjusted under 35 U.S.C. 154(b) by 0 days.

(21) Appl. No.: 09/689,811

(22) Filed: Oct. 13, 2000

(51) Int. Cl.[7] ..... G06G 7/12
(52) U.S. Cl. ..... 327/563; 327/359
(58) Field of Search ..... 327/563, 359, 327/103, 560, 543, 561; 330/252, 253, 300

(56) References Cited

U.S. PATENT DOCUMENTS 5,467,090 A * 11/1995 Baumgartner et al. ..... 341/155
5,493,205 A * 2/1996 Gorecki ..... 330/257
5,510,738 A 4/1996 Gorecki et al. ..... 327/103
5,652,545 A * 7/1997 Miyashita et al. ..... 330/253
5,661,432 A 8/1997 Chang et al. ..... 327/552
5,668,502 A 9/1997 Rijns ..... 330/254
5,912,583 A 6/1999 Pierson et al. ..... 327/553

* cited by examiner

*Primary Examiner*—Timothy P. Callahan
*Assistant Examiner*—Linh Nguyen
(74) *Attorney, Agent, or Firm*—Volentine Francos, PLLC

(57) ABSTRACT

A cascode transconductor circuit controls the transconductance of a differential stage with an active load followed by a cascode or folded-cascode current follower in discrete steps. The circuit includes a transconductor receiving first and second input voltages, and outputting first and second internal currents, a first resistive divider receiving the first internal current at a digitally-selected first node, and generating a third internal current at a third node, a second resistive divider receiving the second internal current at a digitally-selected second node, and generating a fourth internal current at a fourth node, and a cascode circuit receiving the third and fourth internal currents and supplying first and second output currents.

27 Claims, 14 Drawing Sheets

DIGITALLY PROGRAMMABLE TRANSCONDUCTOR

BACKGROUND OF THE INVENTION

The present invention relates to ways of controlling the transconductance of a differential stage with active load followed by a cascode current follower (transconductor) in discrete steps. More particularly, the present invention proposes a transconductor with a digitally programmable transconductance and substantially constant DC operating point. The present invention also proposes an accurate transconductance setting that depends on a master value and on ratios of similar components integrated on the same chip.

The basic setting of the transconductance of a differential stage is through a tail current. The DC operating point is also dependent on the value of the tail current. There are certain circuit configurations, like programmable amplifiers or filters, where changing the transconductance has to be done in discrete steps, and without affecting other parameters such as the distortion level.

FIG. 1 shows a conventional digitally-programmable transconductor circuit. The transconductor circuit presented in FIG. 1 is derived from a source degenerated differential pair. It includes a current generator 30, right and left precision transconductors 40 and 50, and a degeneration resistance 60. The current generator 30 includes a left current generator 32 and a right current generator 34. The right and left precision transconductors 40 and 50 each include a right or left operational amplifier 44, 54 and a right or left PMOS transistor 46, 56. The PMOS transistor 46, 56 passes a right or left current $I_L$ or $I_R$, and is controlled by the output of the corresponding operational amplifier 44, 54. Each of the right or left operational amplifier 44, 54 accepts a corresponding left or right voltage $V_L$ or $V_R$ at a non-inverting input 42, 52 and a feedback loop from the degeneration resistance 60 at a negative input 43, 53. The degeneration resistance 60 includes a plurality of degeneration resistors $R_{D1}$, $R_{D2}$, $R_{D3}$, $R_{D4}$, and $R_{D5}$ and a plurality of programming switches $S_{P1}$, $S_{P2}$, $S_{P3}$, $S_{P4}$, $S_{P5}$, and $S_{P6}$. The degeneration resistors can be classified as first and second left resistors $R_{D1}$ and $R_{D2}$, a center resistor $R_{D3}$, and first and second right resistors $R_{D4}$ and $R_{D5}$.

The right and left precision transconductors 40 and 50 take their feedback from taps on the plurality of degeneration resistors $R_{D1}$, $R_{D2}$, $R_{D3}$, $R_{D4}$, and $R_{D5}$ through the plurality of programming switches $S_{P1}$, $S_{P2}$, $S_{P3}$, $S_{P4}$, $S_{P5}$, and $S_{P6}$. These switches are controlled by a plurality of switch control signals $C_1$ to $C_3$.

Through the selection of a particular pair of taps the resulting degeneration resistance can be properly divided. The five degeneration resistors are divided by the switches into a central resistance $R_C$, a right lateral resistance $R_{RL}$, and a left lateral resistance $R_{LL}$. The lateral resistances $R_{RL}$ and $R_{LL}$ are included in the respective feedback loops of the precision transconductors 40 and 50, and the central resistance passes a side current $I_S$. The feedback of the precision transconductors 40 and 50 forces the input voltage across the resultant center resistance $R_C$.

Table 1 below shows an example of how the central resistance $R_c$ and the lateral resistances $R_{RL}$ and $R_{LL}$ are determined based on the status of the programming switches $S_{P1}$, $S_{P2}$, $S_{P3}$, $S_{P4}$, $S_{P5}$, and $S_{P6}$.

TABLE 1

| $S_{P1}$ | $S_{P2}$ | $S_{P3}$ | $S_{P4}$ | $S_{P5}$ | $S_{P6}$ | $R_{RL}$ | $R_{LL}$ | $R_C$ |
|---|---|---|---|---|---|---|---|---|
| OFF | ON | OFF | OFF | ON | OFF | $R_{D5}$ | $R_{D1}$ | $R_{D2} + R_{D3} + R_{D4}$ |
| OFF | OFF | ON | ON | OFF | OFF | $R_{D4} + R_{D5}$ | $R_{D1} + R_{D2}$ | $R_{D3}$ |

The central resistance $R_c$ defines the AC current generated by the transconductor. By changing the position of the taps, the value of the resistor exposed to the input voltage changes. This yields an equivalent transconductance as follows:

$$g_m = \frac{I_R - I_L}{V_R - V_L} = \frac{1}{R_C} \tag{1}$$

Another drawback of this circuit becomes apparent at high frequency, where it is necessary to have high speed amplifiers drawing important currents for the feedback to be effective.

An implementation of a continuously adjustable transconductance circuit is presented in FIG. 2. This continuously adjustable transconductance circuit includes first and second precision transconductors 210 and 220, first through third tunable transistors $T_{TUN1}$, $T_{TUN2}$, and $T_{TUN3}$, a plurality of resistors R connected between inputs of the transconductors 210 and 220, a capacitor C connected between outputs of the transconductors 210 and 220, and a variety of transistors T and current sources 260.

The precision transconductors 210 and 220 each include an operational amplifier 212, 222 and a transistor $T_{T1}$, $T_{T2}$, and the transconductors 210 and 220 are connected to have degeneration resistor.

The output currents $i_{out1}$ and $i_{out2}$ of the circuit are steered by the tunable transistors $T_{TUN1}$, $T_{TUN2}$, and $T_{TUN3}$ into the inputs of a folded-cascode. Complementary weighted currents are summed on the low impedance of the folded-cascode, providing opposite AC currents to the outputs.

Each of the tunable transistors $T_{TUN1}$, $T_{TUN2}$, and $T_{TUN3}$ provide a respective tunable resistance $R_{TUN1}$, $R_{TUN2}$, or $R_{TUN3}$. The resistance presented by each of the tunable transistors $T_{TUN1}$ ($R_{TUN1}$), $T_{TUN2}$ ($R_{TUN2}$), and $T_{TUN3}$ ($R_{TUN3}$) varies with first and second control voltages $V_1$, and $V_2$ supplied to the inputs of the transistors $T_{TUN1}$, $T_{TUN2}$, and $T_{TUN3}$. If, for example, the first and third tunable transistors $T_{TUN1}$ and $T_{TUN3}$ are identical, then the first and third tunable resistances will also be identical ($R_{TUN1}$= $R_{TUN3}$), since they both receive the first control voltage $V_1$. For differential output currents from the transconductor $i_1=i_i$, $i_2=(-i_i)$, we have:

$$i_A = \left(\frac{R_{TUN2}}{2R_{TUN1} + R_{TUN2}}\right) i_1 \tag{1}$$

-continued $$i_B = -\left(\frac{R_{TUN2}}{2R_{TUN1} + R_{TUN2}}\right)i_1 \quad (2)$$

The fraction $$\frac{R_{TUN2}}{2R_{TUN1} + R_{TUN2}}$$

of the current generated by the input transconductor that is distributed to the output changes with $R_{TUN1}=R_{TUN3}$, $R_{TUN2}$, i.e., this fraction of the current is a function of $R_{TUN1}$, $R_{TUN2}$, and $R_{TUN3}$. The global transconductance appears as a fraction of the input stage transconductance. This ratio is voltage controlled. The dependence of the output current on the individual "resistor" values is not linear unless by electronic means the sum $(2R_{TUN1}+R_{TUN2})$ is kept constant.

The current sources 260 are preferably bias current sources, and the resistors R form a main transconductance setting. In this case, the transconductance of the stage is a fraction (depending upon $V_1$, and $V_2$) of (1/R).

Another way of steering the current of the input transconductor is shown in FIG. 3. The circuit of FIG. 3 includes an input transconductor 305, voltage control current steering circuit 310, a common mode feedback circuit 330, and a plurality of transistors T.

The input transconductor 305 includes first and second sections 350 and 360, each functioning as a differential amplifier. The first section 350 includes first through fourth transistors $T_1$, $T_2$, $T_3$, and $T_4$. The second section 360 includes fifth through seventh transistors $T_5$, $T_6$, and $T_7$.

The voltage controlled current steering circuit 310 includes eighth through eleventh transistors $T_8$, $T_9$, $T_{10}$, and $T_{11}$, formed into two differential pairs. The eighth and ninth transistors $T_8$ and $T_9$ form one differential pair, and the tenth and eleventh transistors $T_{10}$ and $T_{11}$, form the other differential pair.

A fraction of the current generated by the input transconductor 305 is transmitted to the outputs $i_{out1}$ and $i_{out2}$ through a voltage controlled current steering circuit composed of the two differential pairs (formed from the differential transistors $T_8$, $T_9$, $T_{10}$, and $T_{11}$). The circuit has the disadvantages of requiring a high supply voltage to accommodate the various stacked stages, and experiencing difficulty with digitally controlling the current steering.

FIG. 4 shows a design for a switchable amplifier. This switchable amplifier is similar to the circuit of FIG. 1 in that a resistor string is used as a degeneration resistor for an enhanced transconductor ($T_1$-$T_3$; $T_2$-$T_4$), i.e., ($T_1$ and $T_3$) and ($T_2$ and $T_4$) each form a composite transistor. This switchable amplifier includes first through sixth transistors $T_1$ to $T_6$, a degeneration resistance 410, first and second resistors 422 and 424, and first through fourth current sources 432, 434, 436, and 438.

The degeneration resistance 410 includes 2n degeneration resistors $R_{A1}$ to $R_{An}$ and $R_{B1}$ to $R_{Bn}$, and (2n+2) switches $S_{A1}$ to $S_{A(n+1)}$ and $S_{B1}$ to $S_{B(n+1)}$, where n is an integer greater than 1. As with the circuit of FIG. 1, the switches $S_{A1}$ to $S_{A(n+1)}$ and $S_{B1}$ to $S_{B(n+1)}$ are controlled to create a central resistance $R_C$ and left and right lateral resistances $R_{LL}$ and $R_{LR}$.

The current of the third and fourth transistors $T_3$, $T_4$ is injected into symmetrically placed taps of the degeneration resistance 410. In this way, the left and right lateral resistances $R_{LL}$ and $R_{LR}$ are included in the local feedback loops, but still conduct DC currents. In this circuit, most of the differential input voltage appears across the center resistance $R_C$, in a manner similar to the circuit of FIG. 1.

SUMMARY OF THE INVENTION

It is thus an object of the present invention to overcome or at least minimize the various drawbacks associated with conventional techniques for controlling the transconductance of a differential stage.

In an effort to meet this and other objects of the invention, and according to one aspect of the present invention, a cascode transconductor circuit is provided, i.e., a transconductor with a cascode output stage. This cascode transconductor includes a transconductor, first through fourth resistors, a cascode circuit, and a dummy folded-cascode.

The transconductor receives first and second input voltages, and outputs first and second internal currents. The first resistor is connected between first and third nodes, and the second resistor is connected between the first node and a fifth node. The first and second resistors form a first resistive divider that receives the first internal current at the first node, and generates a third internal current at the third node.

The third resistor is connected between second and fourth nodes, and the fourth resistor connected between the second node and the fifth node. The third and fourth resistors form a second resistive divider that receives the second internal current at a second node, and generates a fourth internal current at a fourth node.

The cascode circuit receives the third and fourth internal currents and supplies first and second output currents. The dummy folded-cascode connected to the fifth node. The dummy folded-cascode may be a single-ended low-impedance input folded-cascode.

According to another aspect of the invention, a cascode transconductor circuit, is provided that includes a transconductor receiving first and second input voltages, and outputting first and second internal currents, a first resistor network receiving the first internal current at a first node, and generating a third internal current at a third node, a second resistor network receiving the second internal current at a second node, and generating a fourth internal current at a fourth node, and a cascode circuit receiving the third and fourth internal currents and supplying first and second output currents.

The first resistor network may comprise p first resistors connected in series between the third node and a fifth node, and (p+1) first switches, each connected between the first node and an end of one of the p first resistors, such that each first resistor is connected to two of the (p+1) first switches. Similarly, the second resistor network may comprise p second resistors connected in series between the fourth node and the fifth node, and (p+1) second switches, each connected between the second node and an end of one of the p second resistors, such that each second resistor is connected to two of the (p+1) second switches. In this case, p is an integer greater than 1.

Preferably, the $i^{th}$ first resistor and the $i^{th}$ second resistor have the same value. In this case i is an integer between 1 and p. Preferably, during operation only one of the first switches and one of the second switches are closed at a given time.

The first and second switches may each comprise a transistor controlled by one of a plurality of control signals. The first and second resistors may each comprise a transistor controlled by a bias voltage.

According to yet another aspect, a cascode transconductor circuit is provided that comprises a transconductor receiving first and second input voltages, and outputting first and second internal currents, a first R-nR network receiving the first internal current at a first node, and generating a third internal current at a third node, a second R-nR network receiving the second internal current at a second node, and generating a fourth internal current at a fourth node, and a cascode circuit receiving the third and fourth internal currents and supplying first and second output currents.

The first R-nR network may comprise p first resistors connected in series between the third node and a fifth node, (p−1) second resistors, each connected between the fifth node and a connection between two of the p first resistors, such that each meeting of two of the p first resistors is connected to one of the (p−1) second resistors and (p+1) first switches, each connected between the first node and an end of one of the p first resistors, such that each first resistor is connected to two of the (p+1) first switches. Similarly, the second R-nR network may comprise p third resistors connected in series between the fourth node and the fifth node, (p−1) fourth resistors, each connected between the fifth node and a connection between two of the p third resistors, such that each meeting of two of the p third resistors is connected to one of the (p−1) fourth resistors, and (p+1) second switches, each connected between the third node and an end of one of the p third resistors, such that each third resistor is connected to two of the (p+1) second switches.

Preferably, during operation only one of the first switches and one of the second switches are closed at a given time.

Each of the first and second switches may comprise a transistor controlled by one of a plurality of control signals.

Preferably, the $2^{nd}$ through $(p-1)^{th}$ first resistors and the $2^{nd}$ through $(p-1)^{th}$ third resistors all have a first resistance value, and the $1^{st}$ and $p^{th}$ first resistors, the $1^{st}$ and $p^{th}$ third resistors, the (p−1) second resistors, and the (p−1) fourth resistors all have a second resistance value substantially equal to an integral multiple of the first resistance value. In the case of a R-2R network, the second resistance value should be twice the first resistance value.

BRIEF DESCRIPTION OF THE DRAWINGS

The above and other objects and advantages of the present invention will become readily apparent from the description that follows, with reference to the accompanying drawings, in which.

DETAILED DESCRIPTION OF THE PREFERRED EMBODIMENTS

The present invention provides ways to accurately, digitally program the transconductance of a cascode transconductor while maintaining such parameters of the input transconductor as the input voltage range. According the preferred embodiments of the present invention shown below, there is no DC current flowing through the resistive elements, which improves the matching of the characteristics of the active resistive elements. In addition, the operating point does not change by switching, allowing more relaxed operating conditions for dynamically selected elements. These circuits are also appropriate for operation at low supply voltages.

Figure 1:
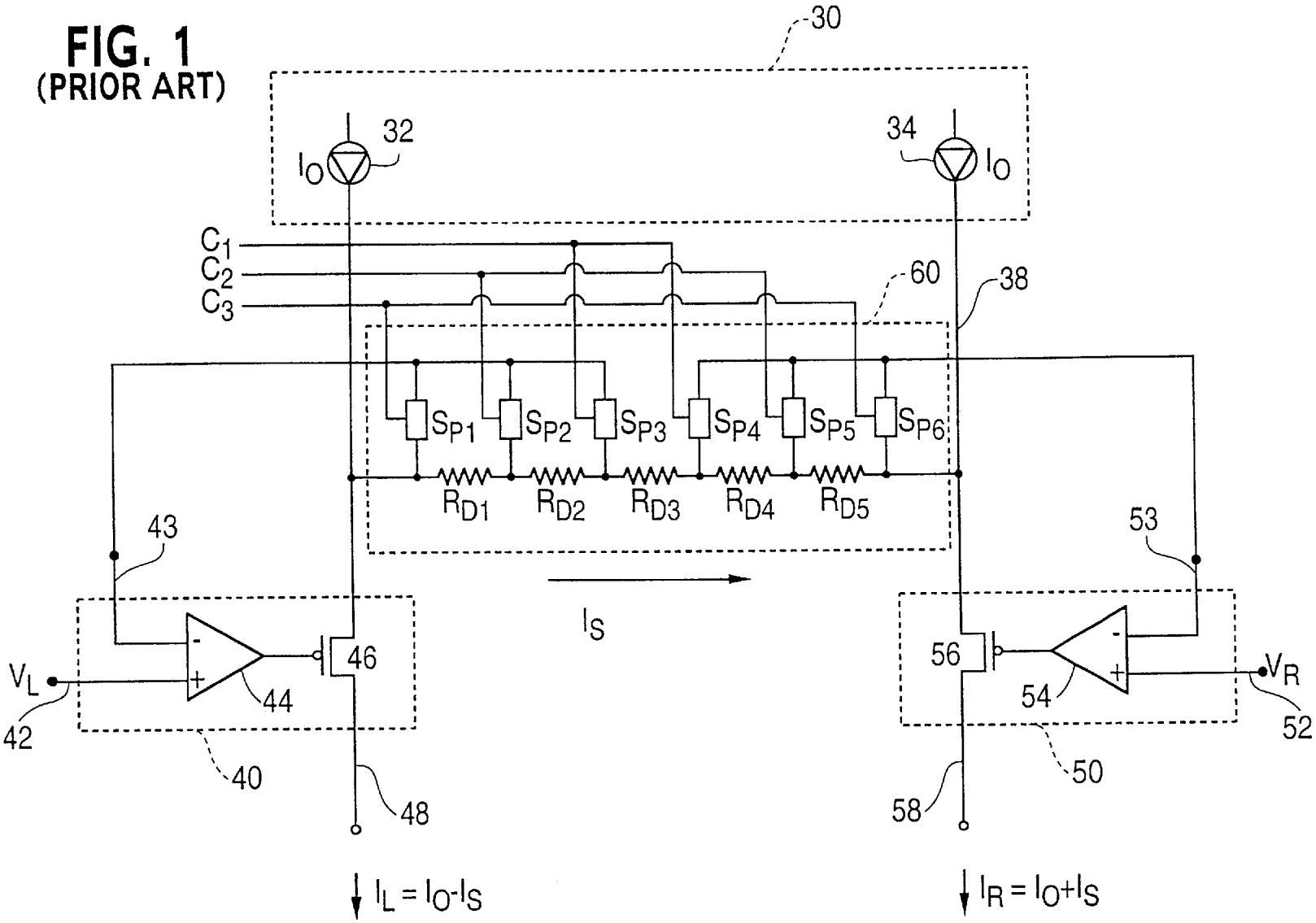
FIG. 1 (PRIOR ART)
FIG. 1 is a circuit diagram showing a conventional transconductor that has a programmable source degeneration resistor.
Figure 2:
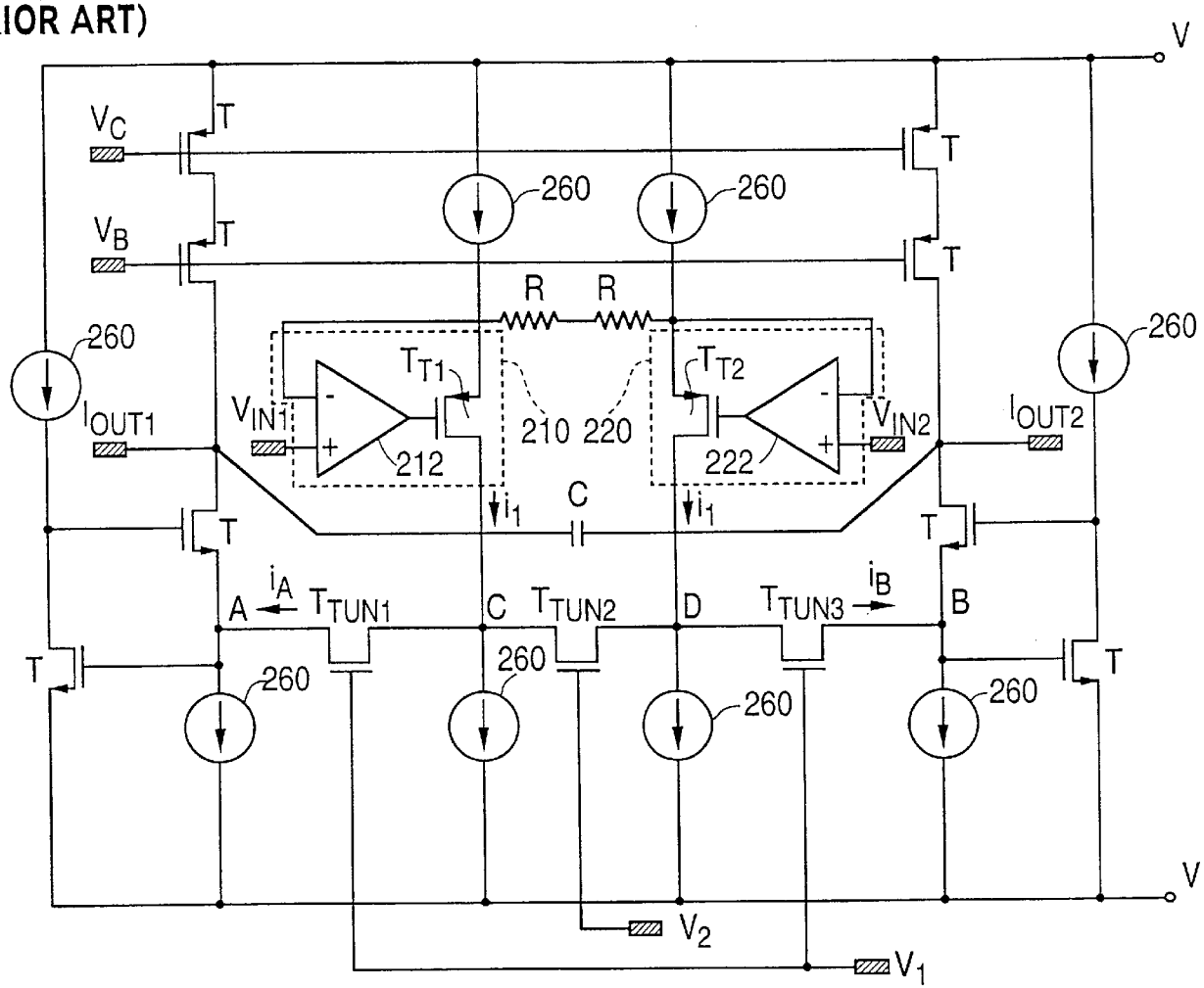
FIG. 2 (PRIOR ART)
FIG.2 is a circuit diagram showing a conventional continuously adjustable transconductor that employs tuned transistors for current steering.
Figure 3:
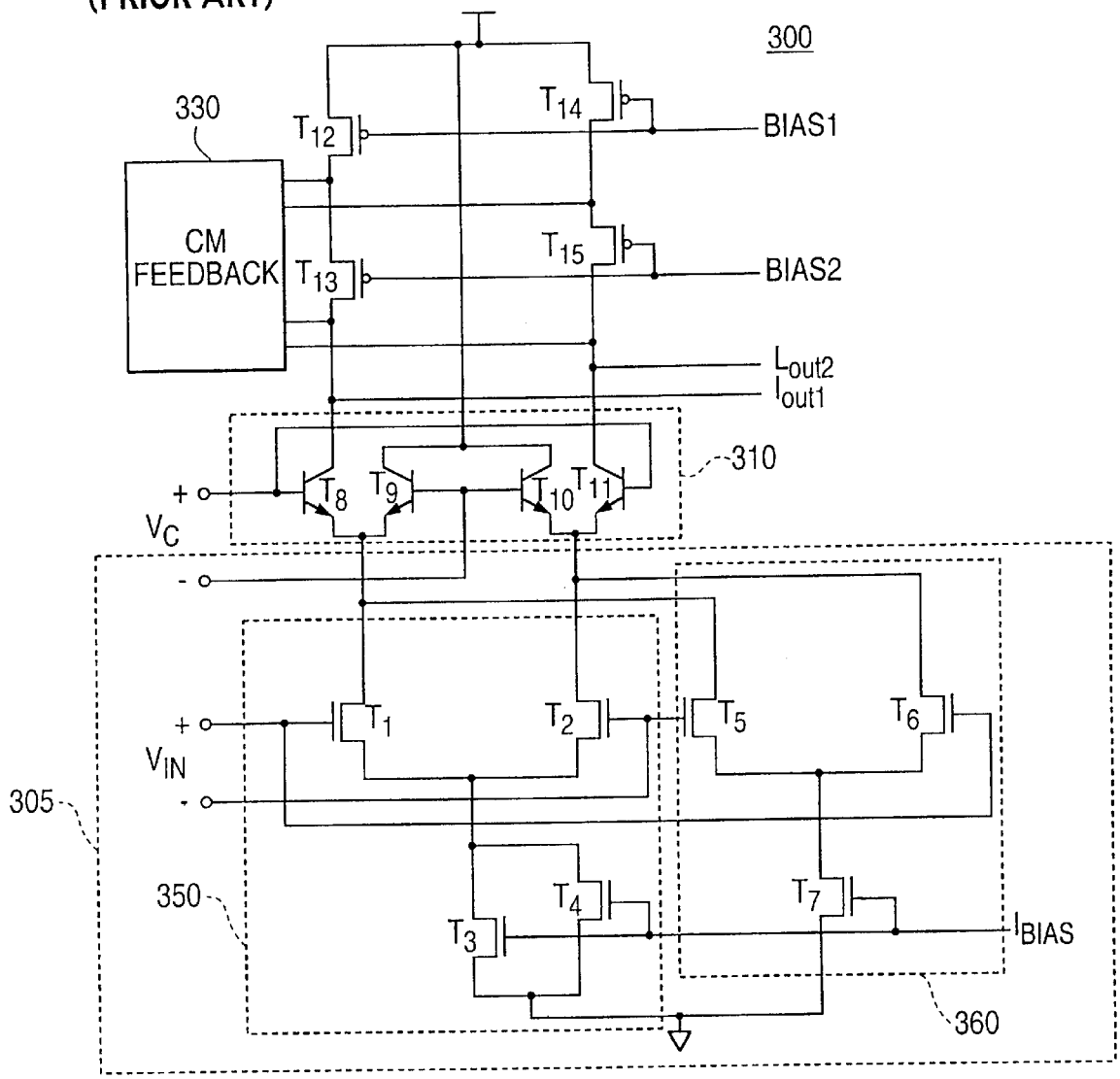
FIG. 3 (PRIOR ART)
FIG. 3 is a circuit diagram showing a conventional continuously adjustable transconductor that employs differential stage current steering.
Figure 4:
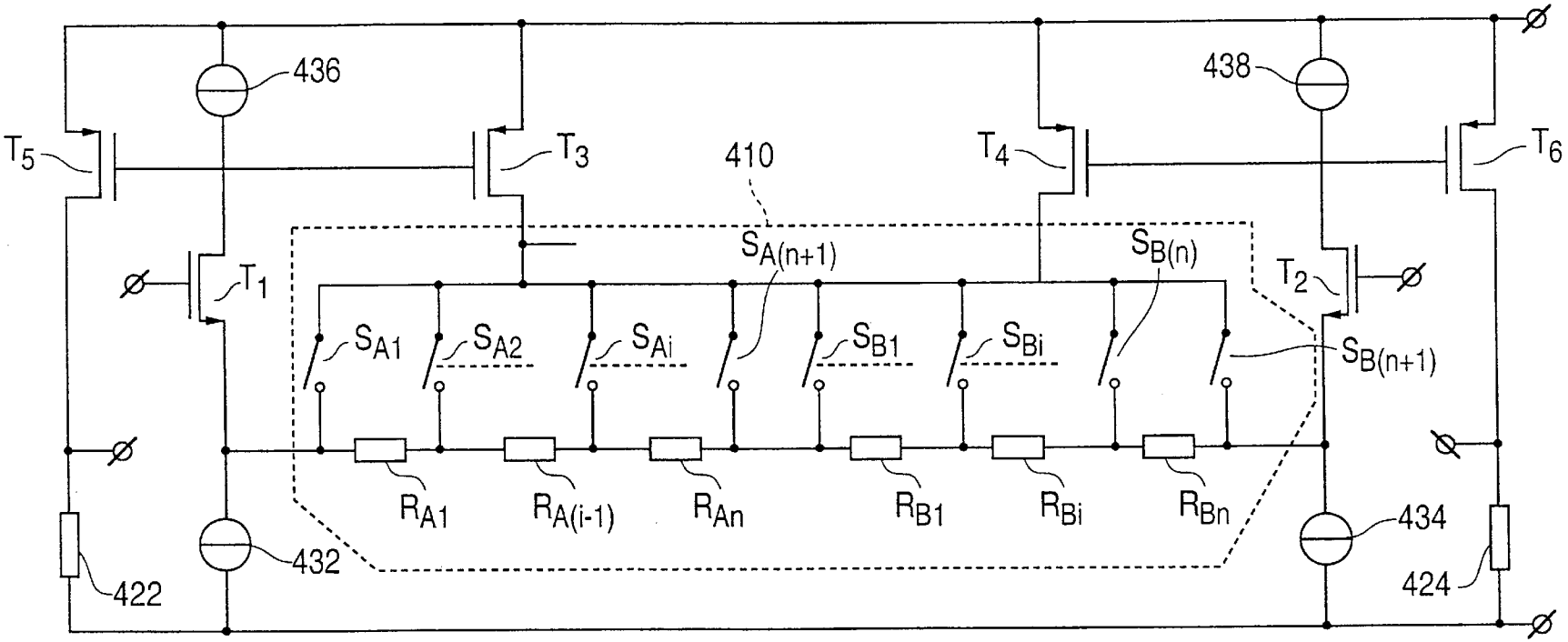
FIG. 4 is a circuit diagram showing a conventional amplifier having switchable gain.
Figure 5:
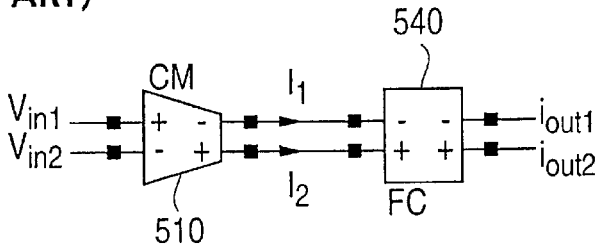
FIG. 5 (PRIOR ART)
FIG. 5 is a block diagram showing a conventional transconductor with differential output folded-cascode.
Figure 6:
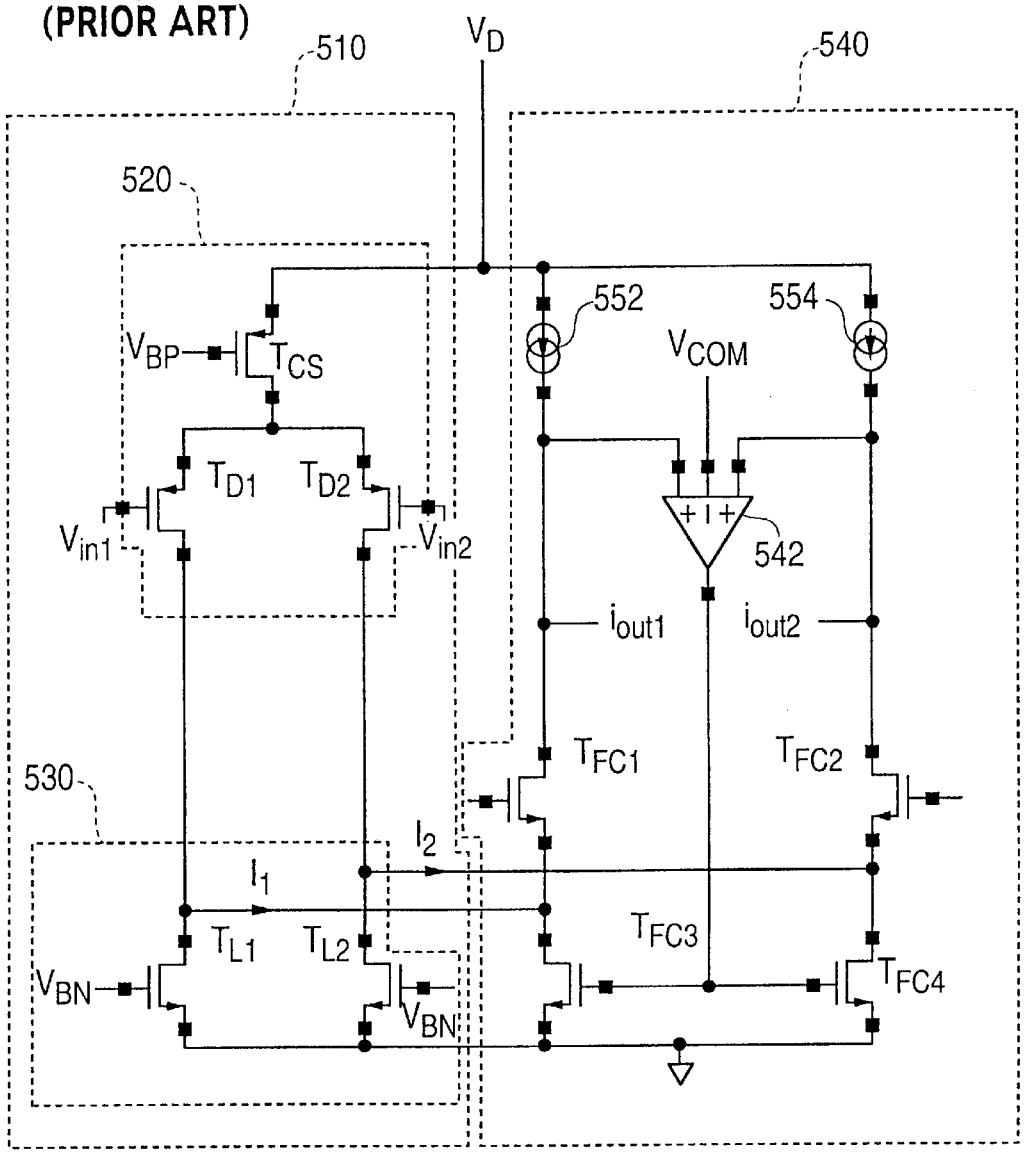
FIG. 6 (PRIOR ART)
FIG. 6 is a circuit diagram of the circuit of FIG. 5 having separated loads for the input stages.

A transistor implementation for a conventional folded-cascode transconductor is shown in FIGS. 5 and 6. FIG. 5 is a block diagram showing the transconductor and cascode or folded-cascode, while FIG. 6 is a transistor diagram of the circuit of FIG. 5. The circuit of FIG. 5 includes an input transconductor 510 and a folded-cascode 540. Although in this disclosure, a folded-cascode is described, any sort of current follower, such as a regular cascode, etc. can be used.

The input transconductor 510 includes a PMOS differential pair 520 with a current source load circuit 530. The differential pair 520 includes two differential transistors $T_{D1}$ and $T_{D2}$, and a current source transistors $T_{CS}$. The current source:load circuit includes two load transistors $T_{L1}$ and $T_{L2}$.

The bias voltages $V_{BP}$, $V_{BN}$ applied to the transistors $T_{CS}$, $T_{L1}$, and $T_{L2}$ are generated by a circuit that establishes the same DC currents through the first differential transistor $T_{D1}$, and the first load transistor $T_{L1}$, and through the second differential transistor $T_{D2}$ and the second load transistor $T_{L2}$. This way, the net DC component of each of the transconductor output currents is zero.

The folded-cascode 540 includes a subtracter/amplifier 542, first through fourth folded-cascode transistors $T_{FC1}$, $T_{FC2}$, $T_{FC3}$, and $T_{FC4}$, connected as a differential folded-cascode, and first and second current source loads 552 and 554. The common-mode is set by a feedback loop including the subtracter/amplifier 542. The folded-cascode transistors $T_{FC1}$, $T_{FC2}$, $T_{FC3}$ and $T_{FC4}$ are connected to operate as a current follower. In order to lower the input impedance and to increase the output impedance of the folded-cascode 540, gain-enhancement can be applied to the first and second folded-cascode transistors $T_{FC1}$ and $T_{FC2}$.

Although most of the following preferred embodiments are described with reference to folded-cascodes, it should be understood that a cascode could be used as well in each case. The folded-cascode input impedance is considered low enough as to keep the error of the current division at a convenient value, since the input impedance of the folded-cascode can be lowered considerably using techniques such as gain-enhancement. Therefore, for simplicity, in the following calculations the folded-cascode input impedance is considered to be zero.

Figure 7:
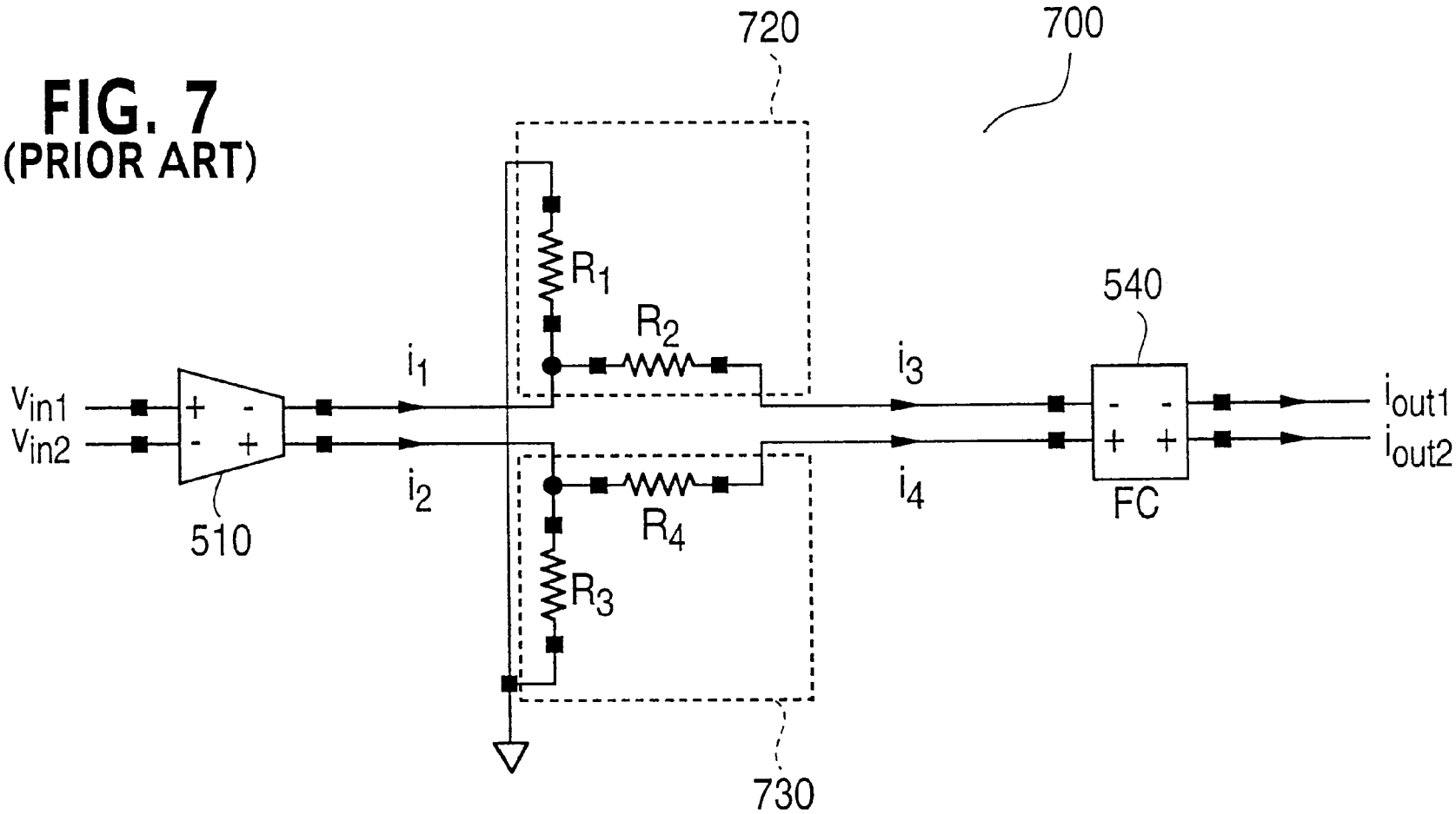
FIG. 7 (PRIOR ART)
FIG. 7 is a circuit diagram showing a conventional folded-cascode transconductor with intermediary resistive divider.

FIG. 7 is a circuit diagram showing a conventional folded-cascode transconductor 700 with an intermediary resistive divider. As shown in FIG. 7, the folded-cascode transconductor 700 includes a transconductor 510, first and second resistive dividers 720 and 730, and a cascode or folded-cascode 540. The first resistive divider includes first and second resistors $R_1$ and $R_2$. The second resistive divider includes third and fourth resistors $R_3$ and $R_4$.

The differential currents generated by the transconductor 510 (having a transconductance $g_m$) in response to the differential input voltage $v_{in}=(v_{in1}-v_{in2})$ are steered by the first and second resistive dividers 720 and 730. The currents flowing through the second and fourth resistors $R_2$ and $R_4$, respectively, enter a low input impedance stage as a cascode or a folded-cascode (FC).

The first through fourth resistors $R_1$ to $R_4$ are preferably chosen to have an equal ratio, according to the following equation.

$$\frac{R_1}{R_2} = \frac{R_3}{R_4} \tag{3}$$

The conditions of equation (3) are sufficient for the correct functioning of an ideal implementation of the proposed circuit. However, for an identical loading of the two branches of a real transconductor we will consider the following equalities.

$$(R_1=R_3);\ (R_2-R_4) \tag{4}$$

Defining $$x = \frac{R_1}{R_1 + R_2},$$

we find that the AC currents injected into the folded-cascode are:

$$i_3\left(\frac{R_1}{R_1 + R_2}\right)\ i_1 = x \cdot i_1 = \left(x \cdot \frac{g_m}{2}\right)v_{dif} \tag{5}$$

$$i_4\left(\frac{R_3}{R_3 + R_4}\right)\ i_2 = x \cdot i_2 = \left(x \cdot \frac{g_m}{2}\right)v_{dif} \tag{6}$$

where $g_m$ is the transconductance of the transconductor 510, and $v_{dif}$ is $(v_{in1}-v_{in2})$. The folded-cascode acts as a current follower, where:

$$i_{out1}=i_3;\ i_{out2}=i_4; \tag{7}$$

The differential output current is:

$$i_{odif}=(i_{out1}-i_{out2})=(x \cdot g_m) \cdot v_{dif}=(g_m)_{eq} \cdot v_{dif}; \tag{8}$$

Thus, the whole circuit acts as a transconductor with a reduced equivalent transconductance $(g_m)_{eq}=(x \cdot g_m)$, where $0 \leqq x \leqq 1$. The value of the transconductance $g_m$ is set by the bias current of the transconductor. The bias can be either fixed or dependent on elements as the temperature or the frequency of a reference signal etc. The disclosed circuit presents a means to obtain an accurate fraction of that transconductance.

Figure 8:
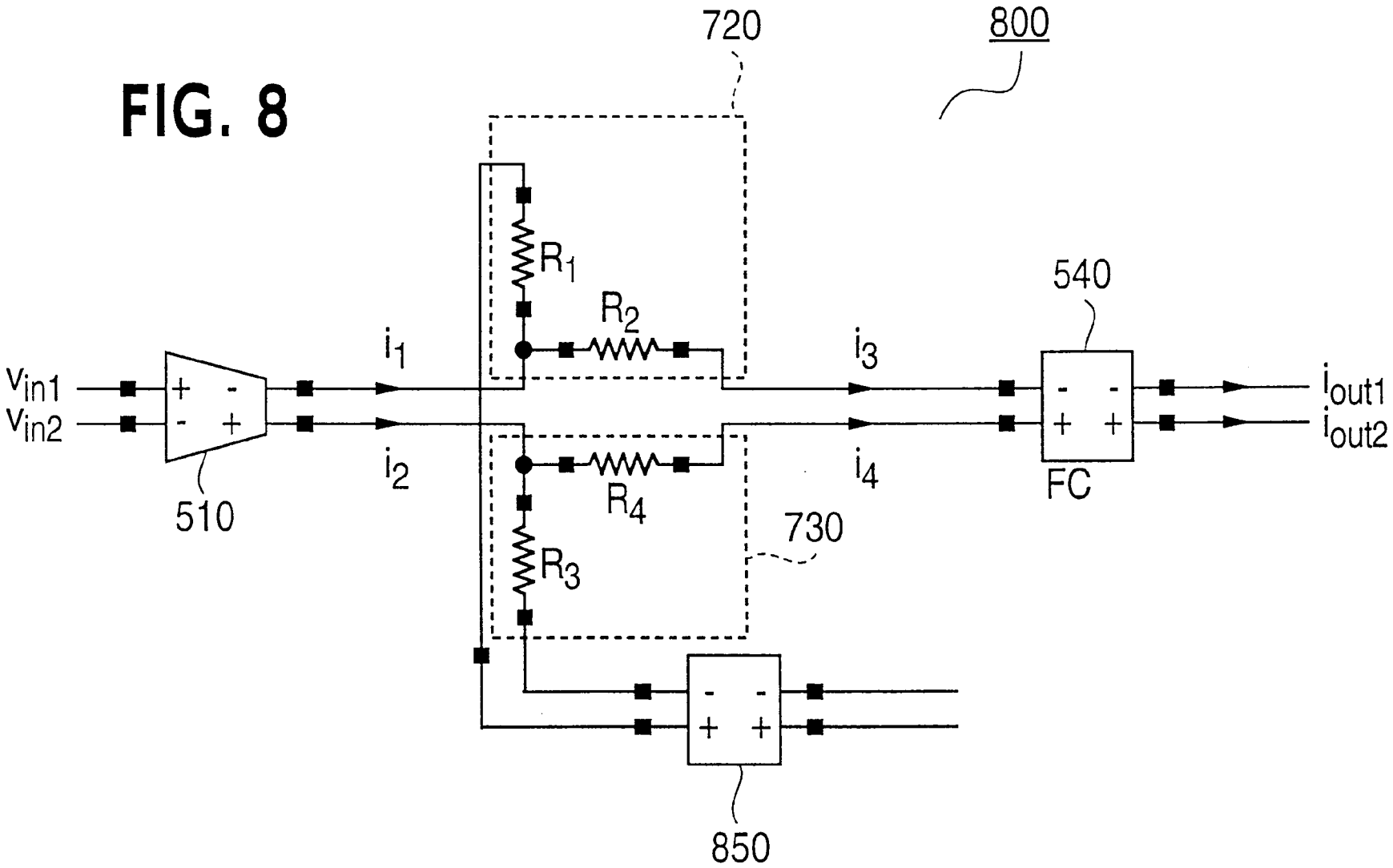
FIG. 8 is a circuit diagram of a folded-cascode transconductor with an intermediary resistive divider and dummy differential folded-cascode bias, according to a first preferred embodiment of the present invention.
Figure 9:
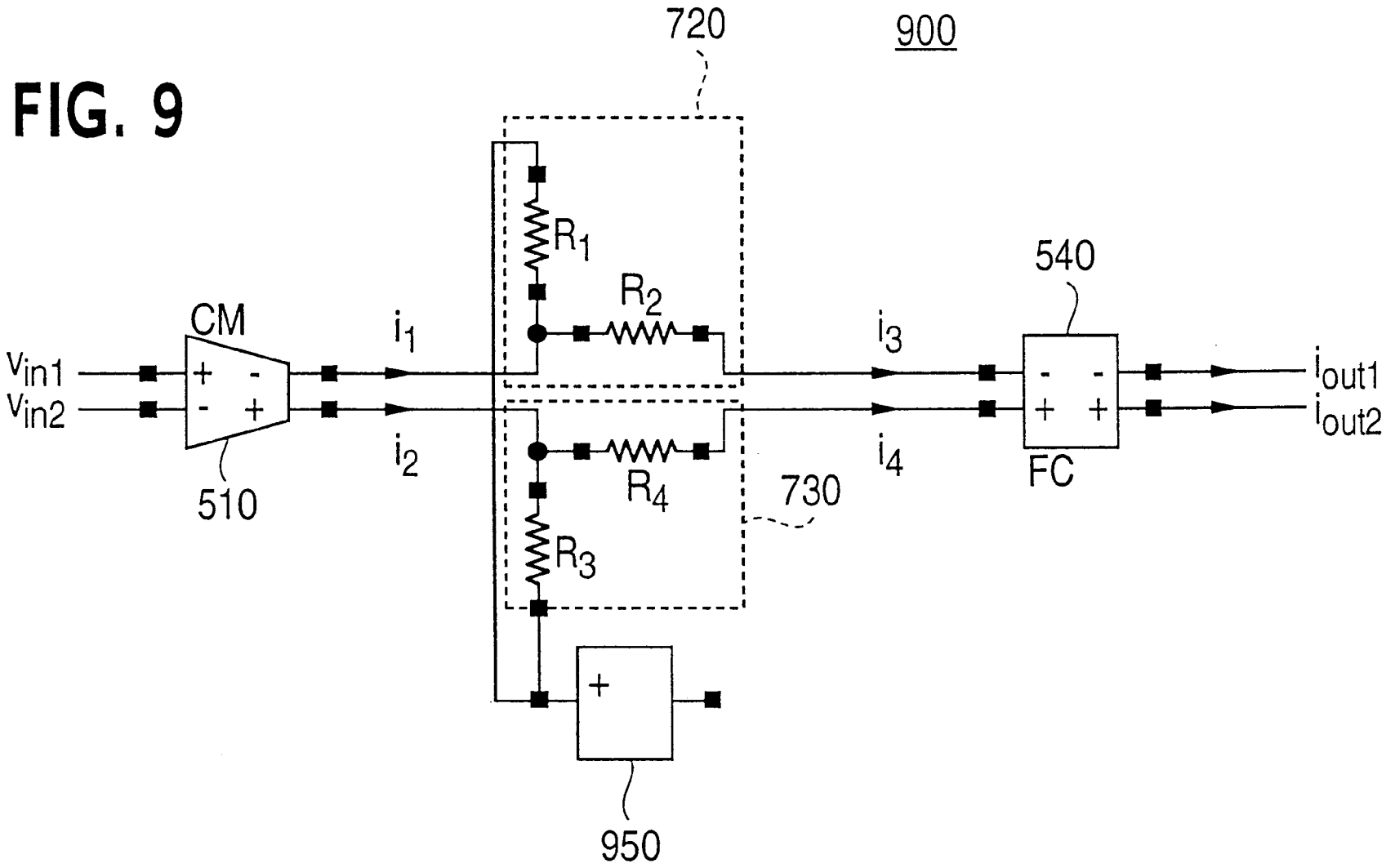
FIG. 9 is a circuit diagram showing a folded-cascode transconductor with intermediary resistive divider and dummy single-ended folded-cascode bias, according to a second preferred embodiment of the present invention.

First and second preferred embodiments of the present invention are shown in FIGS. 8 and 9. In particular, FIG. 8 is a circuit diagram of a folded-cascode transconductor 800 with an intermediary resistive divider and dummy differential folded-cascode bias, according to the first preferred embodiment of the present invention.

In the circuit of FIG. 8 , the AC ground voltage connected to $R_1$ and $R_3$ in FIG. 7, is provided by a dummy folded-cascode 850, which has identical input circuitry and bias as the active folded-cascode 540. The folded-cascode 540 and the dummy folded-cascode 850 provide identical DC voltages at the ends of the resistors $R_1$, $R_2$, $R_3$, and $R_4$. This way there is no DC current flowing through these resistors.

FIG. 9 is a circuit diagram showing a folded-cascode transconductor 900 with intermediary resistive divider and dummy single-ended folded-cascode bias, according to the second preferred embodiment of the present invention. The circuit of FIG. 9 is the same as that shown in FIG. 8, except that the dummy folded-cascode 850 is replaced by a single low-impedance input folded-cascode 950. This is possible because of the differential nature of the output currents from the transconductor 510.

Figure 10:
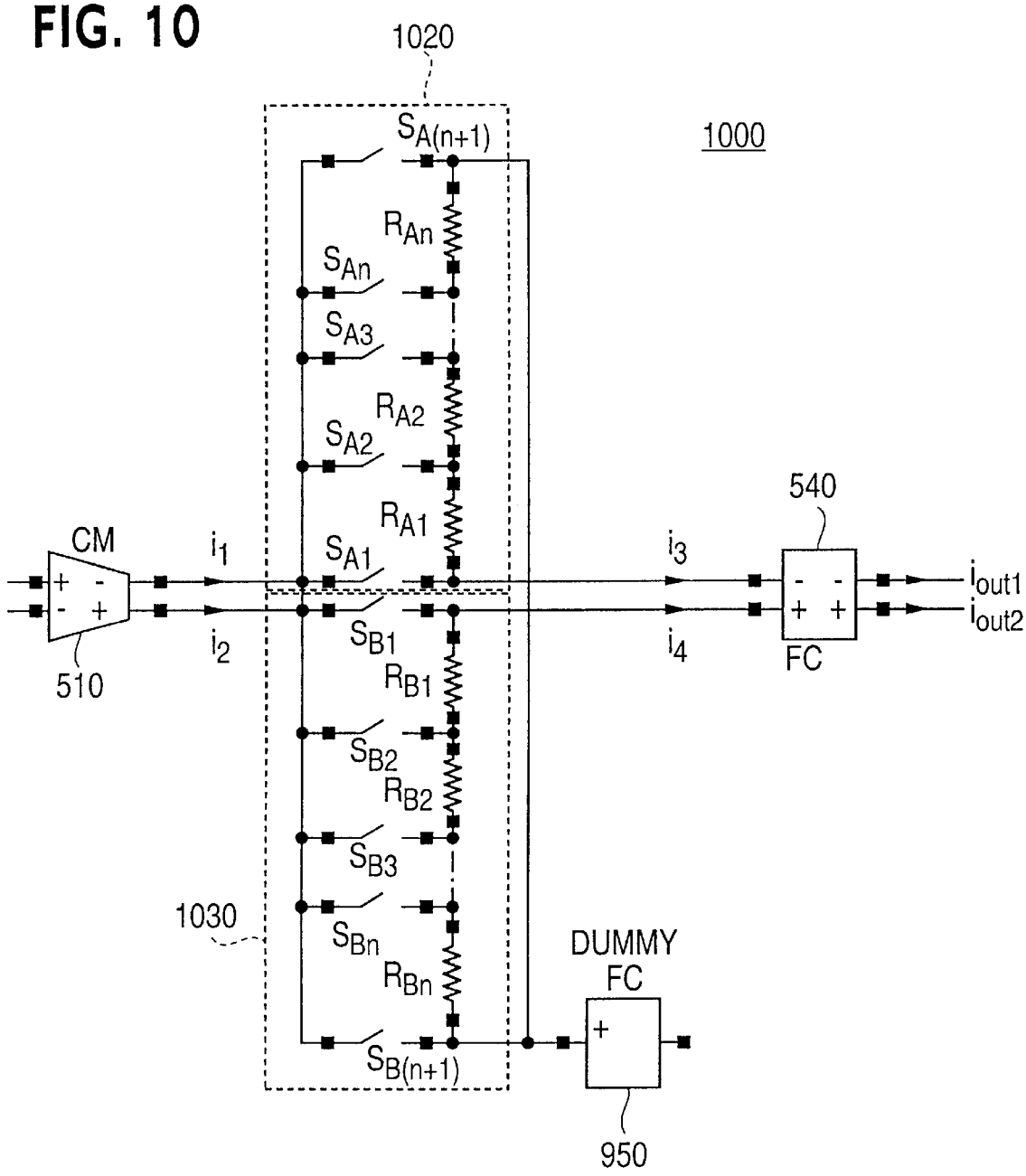
FIG. 10 is a circuit diagram showing a folded-cascode transconductor with intermediary resistive network having a switchable transconductance, according to third and fourth preferred embodiments of the present invention.

FIG. 10 is a circuit diagram showing a folded-cascode transconductor 1000 with an intermediary resistive network having a switchable transconductance, according to third and fourth preferred embodiment of the present invention. The circuit of FIG. 10 is derived from the circuit of FIG. 9. The transconductor circuit includes an input transconductor 510, first and second resistor networks 1020 and 1030, an output folded-cascode 540, and a biasing dummy single-ended folded-cascode 950. The first resistor network includes a first plurality of resistors $R_{A1}$, to $R_{An}$ connected in a network, and a first plurality of switches $S_{A1}$ to $S_{An+1}$ that connect the outputs of the transconductor 510 to symmetric taps of the first resistor network 1020. Similarly, the second resistor network 1030 includes a second plurality of resistors $R_{B1}$, to $R_{Bn}$ connected in a network, and a second plurality of switches $S_{B1}$ to $S_{Bn+1}$ that connect the outputs of the transconductor 510 to symmetric taps of the second resistor network 1030. In each case, n is an integer greater than 1.

The following equalities are true for the output current in the case that $R_{Ak}=R_{Bk}=R_k$, fork=1, . . . , n, and when the switches $S_{Ak}$ and $S_{Bk}$ turned on and all the other switches turned off; The values $R_k$ of the resistances are not necessarily equal, i.e., while $(R_{A1}=R_{B1}=R_1)$, $(R_{A2}=R_{B2}=R_2)$, . . . $(R_{An}=R_{Bn}=R_n)$, it is not necessarily true that $(R_1=R_{2=Rn})$.

$$i_{out1}(n+1)=0 \tag{9}$$

$$i_{out1}(k) = \left(\frac{\sum_{j=k}^{n} R_{Aj}}{\sum_{j=1}^{n} R_{Aj}}\right) i_1 = \left(\frac{\sum_{j=k}^{n} R_j}{\sum_{j=1}^{n} R_j}\right) i_1 \quad (10)$$

where k=1, 2, . . . , n.

$$i_{out2}(n+1)=0 \quad (11)$$

$$i_{out2}(k) = \left(\frac{\sum_{j=k}^{n} R_{Bj}}{\sum_{j=1}^{n} R_{Bj}}\right) i_2 = \left(\frac{\sum_{j=k}^{n} R_j}{\sum_{j=1}^{n} R_j}\right) i_2 \quad (12)$$

where k=1, 2, . . . , n.

The equivalent transconductance of the entire circuit is:

$$(g_m)_{eq}(n+1)=0 \quad (13)$$

$$(g_m)_{eq}(k) = \left(\frac{\sum_{j=k}^{n} R_j}{\sum_{j=1}^{k} R_j}\right) g_m \quad (14)$$

where k=1, 2, . . . , n

Figure 11:
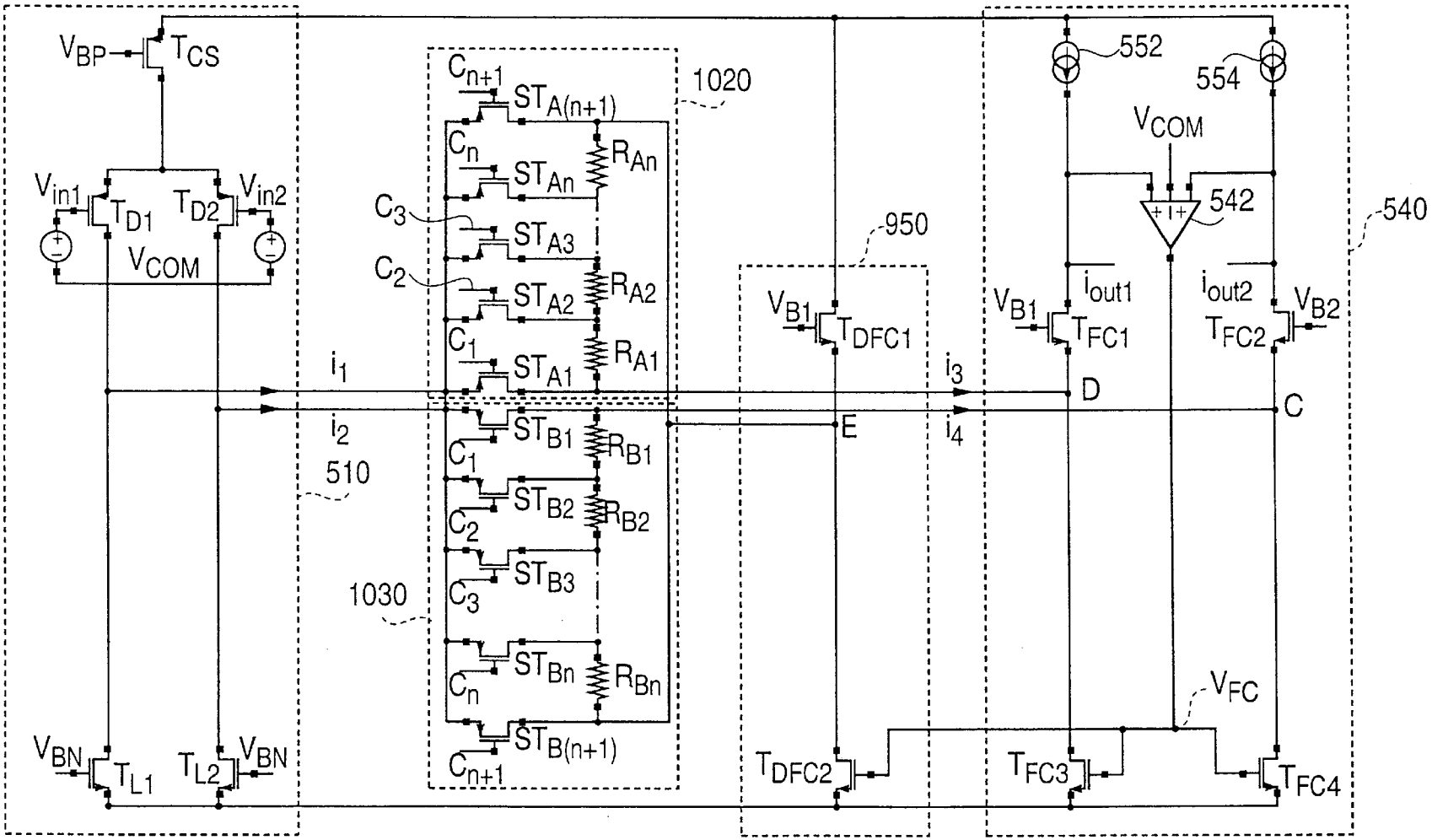
FIG. 11 is a more detailed circuit diagram of the circuit of FIG. 10, according to a fifth preferred embodiment of the present invention.

FIG. 11 is a more detailed circuit diagram of the circuit of FIG. 10, according to the third preferred embodiment of the present invention. More specifically, FIG. 11 is a resistor/transistor implementation of the circuit shown in FIG. 10. The DC-free output currents $i_1$ and $i_2$, from the transconductor 510 are distributed to symmetric taps of the two resistor networks 1020 ($R_{A1}$ to $R_{An}$) and 1030 ($R_{B1}$ to $R_{Bn}$) through digitally controlled switches (transfer gates) represented here by a plurality of NMOS switching transistors ($ST_{A1}$ to $ST_{An}$ and $ST_{B1}$ to $ST_{Bn}$). One end of each resistor network is tied to an input node C or D) of the folded-cascode 540. The other end of each resistor is tied to the bias point E of a bias circuit dummy folded-cascode 950 ($T_{DFC1}$, $T_{DFC2}$) matched to the two branches of the folded-cascode 540 and biased by the same $V_{FC}$ voltage as the output transistors $T_{FC3}$ and $TFC_4$. This way, the voltages at nodes C, D, and E are equivalent:

$$V_C=V_D=V_E \quad (24)$$

which means that there is no net DC current flowing through the resistor networks 1020 and 1030 when the input transconductor is biased to have ($|I_{DTD1}|=I_{DTL1}$) and ($|I_{DTD2}|=I_{DTL2}$).

The switches are preferably controlled by the control signals $C_1$ to $C_n$. There is preferably only one $C_k$, (k=1, . . . , n+1) signal active at a time. One possible way of generating the control signals $C_1$ to $C_{n+1}$ is by decoding a digital control word.

If $C_k$ is active (high level in the case of NMOS switches) and all of the other control signals are inactive, then the global transconductance of the circuit operates according to rules (13) and (14) above.

The resistors of the resistor networks 1020 and 1030 can be either passive elements, such as diffused, polysilicon, or metal resistors, or they can be active resistors.

Figure 12:
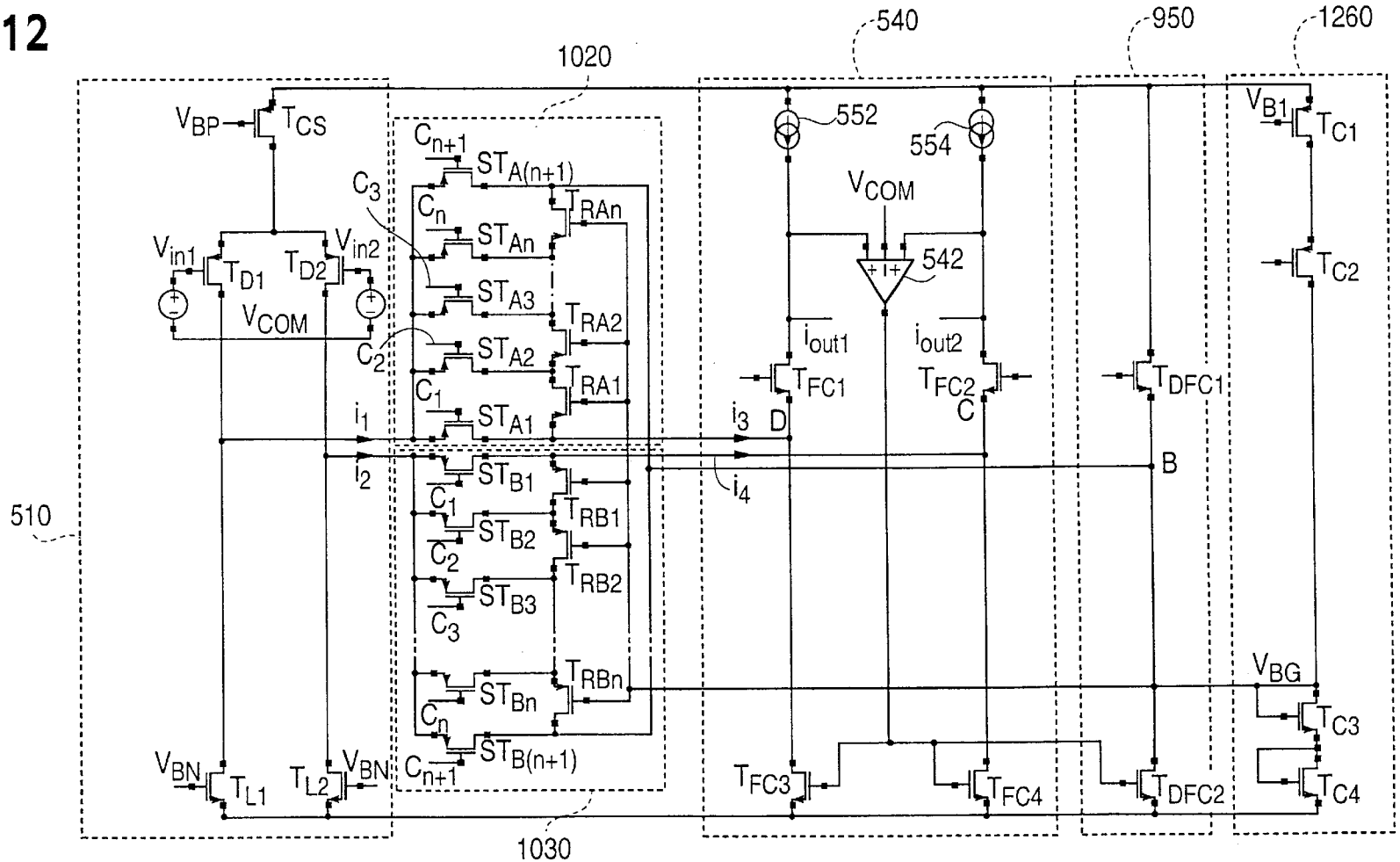
FIG. 12 is a more detailed circuit diagram of the circuit of FIG. 10, according to a sixth preferred embodiment of the present invention.

FIG. 12 is a more detailed circuit diagram of the circuit of FIG. 10, according to the fifth preferred embodiment of the present invention. More specifically, FIG. 12 is a transistor implementation of the circuit of FIG. 10, in which the resistors are replaced by transistors ($T_{RA1}$ to $T_{RAn}$ and $T_{RB1}$ to $T_{RBn}$). The drain-source voltage of these transistors is nominally zero. The transistors work in triode mode. The drain-source resistance $R_k$ of the $k^{th}$ transistor, for a square-law model is:

$$R_k = \frac{1}{\beta_k(V_{GSk} - V_{TH})} \quad (25)$$

where $\beta_K$ is the transfer parameter in strong inversion $$\left[\mu \cdot C_{ox}\left(\frac{W}{L}\right)_k\right],$$

$V_{GSk}$ is the gate-source voltage, and $V_{TH}$ is the threshold of the $k_{th}$ transistor.

Preferably, the gates of all the transistors of this example are biased by the same voltage $V_{BG}$ generated by a bias voltage generator 1260, including first through fourth chain transistors $T_{C1}$, $T_{C2}$, $T_{C3}$, and $T_{C4}$. Because there is no DC current flowing through the transistors in the "resistor" chain, their source voltage is the same (V,B). As a result the gate-source voltage is the same for every transistor in the chain.

with $W_k$ and $L_k$ being the width and length, respectively, of the $k^{th}$ transistor, and with $W_j$. and $L_j$ being the width and length, respectively, of the $j^{th}$ transistor.

Figure 13:
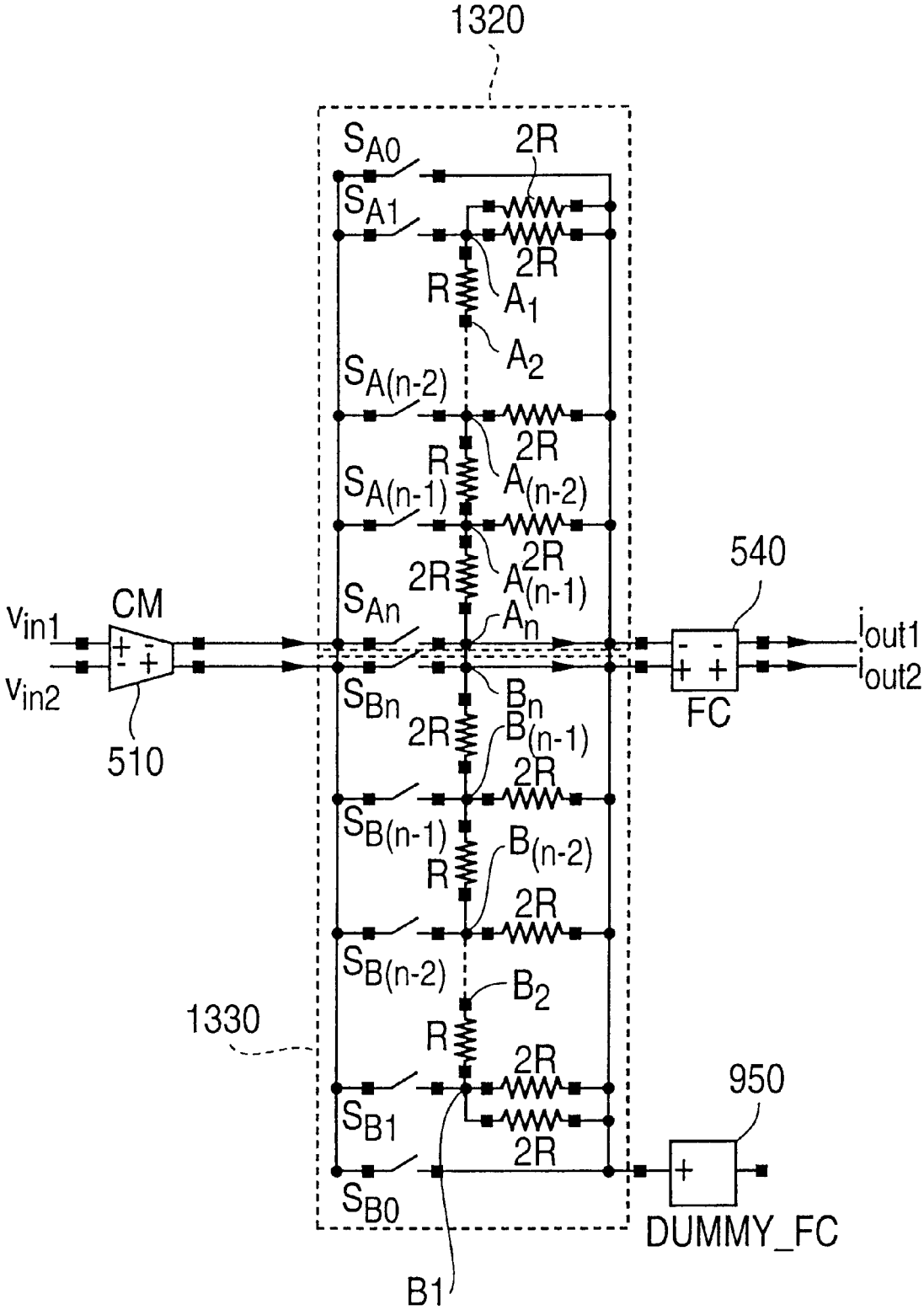
FIG. 13 is a circuit diagram showing a folded-cascode transconductor with intermediary R-nR network having exponentially controlled switchable transconductance, according to a seventh preferred embodiment of the present invention.

FIG. 13 is a circuit diagram showing a folded-cascode transconductor with intermediary R-nR network having exponentially controlled switchable transconductance, according to a fifth preferred embodiment of the present invention. In this embodiment, the first and second resistor networks 1020 and 1030 have been replaced by first and second R-nR networks 1320 and 1330 (alternately called resistor divider networks). Although by way of example, the circuit of FIG. 13 specifically shows the use of first and second R-2R networks, other values for n could clearly be used.

One of the R-2R networks 1320 and 1330 in FIG. 13 is connected to each output line of the transconductor 510. In addition, all but one of the 2R branches of the R-2R networks 1320 and 1330 are connected to the bias point E of the dummy single-ended folded-cascode 950. The internal nodes of the first and second networks 1320 and 1330 are designated $A_1$ to $A_n$ and $B_1$ to $B_n$, respectively.

The outputs of the transconductor 510 can be connected through the switches $S_{A1}$ to $S_{A(n-1)}$ and $S_{B1}$ to $S_{B(n-1)}$, to the nodes $A_1$ to $A_{(n-1)}$ and $B_1$ to $B_{(n-1)}$, respectively. The switches $S_{A0}$ and $S_{B0}$ connect the outputs of the transconductor 510 to the bias point E, allowing no current to flow into the output stage folded-cascode 540. The switches $S_{An}$ and $S_{Bn}$ connect the outputs of the transconductor 510 directly to the corresponding inputs of the folded-cascode 540, bypassing the resistor divider networks 1320 and 1330. There should only be one switch closed at a time in each network 1320 and 1330.

When the inverting output of the transconductor 510 is connected through the switch $S_{Ak}$ to the node $A_k$ of the first network 1320, and the non-inverting output of the transconductor 510 is connected through the switch $S_{Bk}$ to the node $B_k$ of the second network 1330, the output currents $i_{out1}$ and $i_{out2}$ are:

$$i_{out1}(0)=0 \tag{15}$$

$$i_{out1}(k)=\left(\frac{2^k}{3\cdot 2^{n-1}}\right)i_1 \qquad k=1,2,\ldots,n-1 \tag{16}$$

$$i_{out1}(n)=i_1 \tag{17}$$

$$i_{out2}(0)=0 \tag{18}$$

$$i_{out2}(k)=\left(\frac{2^k}{3\cdot 2^{n-1}}\right)i_2 \qquad k=1,2,\ldots,n-1 \tag{19}$$

$$i_{out2}(n)=i_2 \tag{20}$$

As a result, the overall transconductance will be:

$$(g_m)_{eq}(0)=0 \tag{21}$$

$$(g_m)_{eq}(k)=\left(\frac{2^k}{3\cdot 2^{n-1}}\right)g_m \qquad k=1,2,\ldots,n-1 \tag{22}$$

$$(g_m)_{eq}(n)=g_m \tag{23}$$

The circuit of FIG. 13 thus operates as a programmable exponential attenuator for the transconductance.

Figure 14:
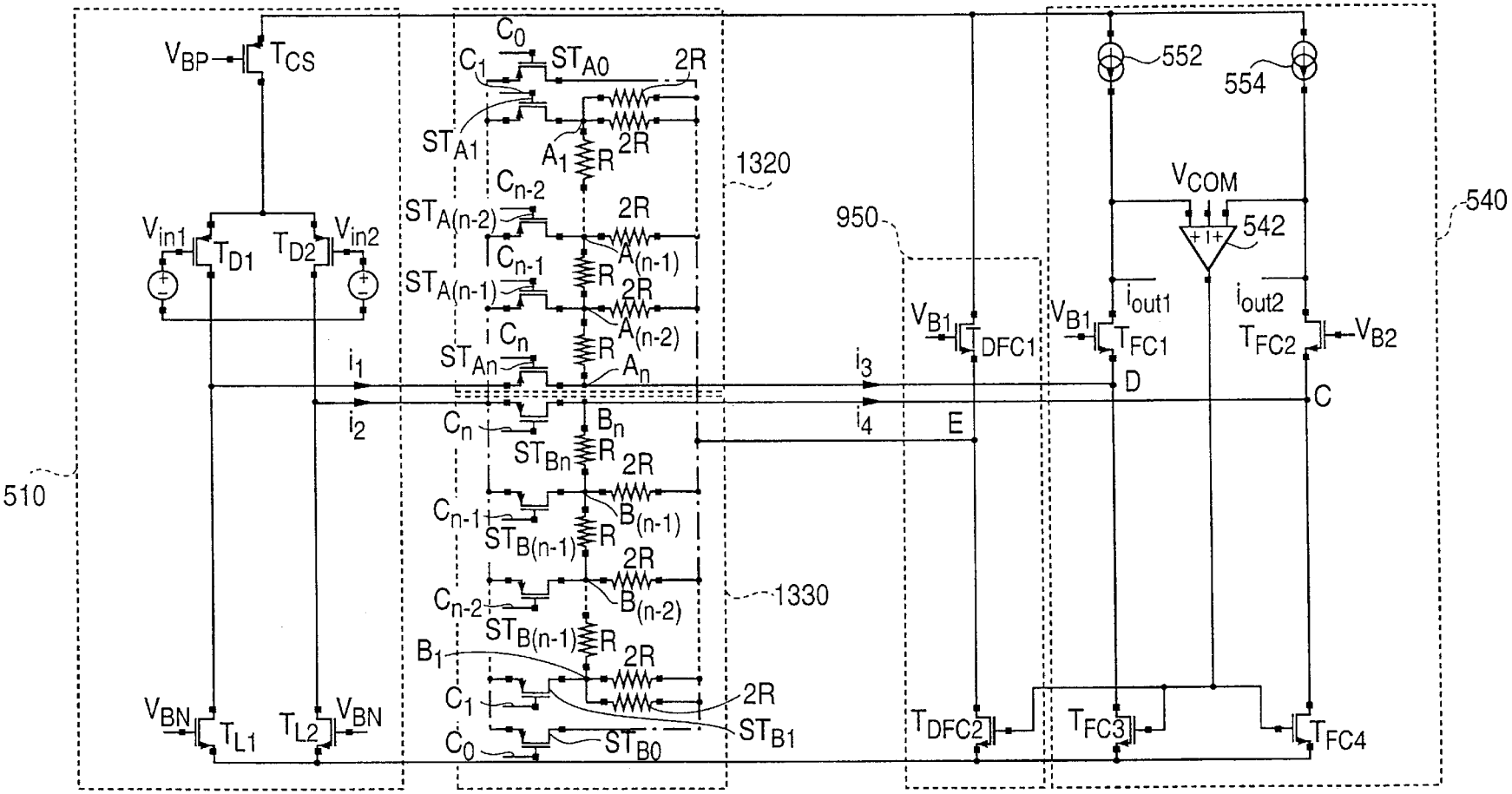
FIG. 14 is a more detailed circuit diagram of the circuit of FIG. 13.

FIG. 14 is a more detailed circuit diagram of the circuit of FIG. 13. As shown in FIG. 14, the DC-free output currents $i_1$ and $i_2$, from the transconductor 510 are distributed to symmetric taps (via nodes $A_k$ and $B_k$, where k=1, 2, . . . , n−1) of the two R-2R resistor networks, or directly into the inputs C, D of the folded-cascode (via nodes $A_n$ and $B_n$), or to the dump node E, each through digitally controlled switches (transfer gates), which are shown in this embodiment as NMOS switching transistors ($S_{TA0}$ to $S_{TAn}$ and $S_{TB0}$ to $S_{TBn}$). The nodes $A_n$ and $B_n$ of the resistor networks 1320 And 1330 respectively coincide with the nodes D and C, which represent the inputs to the folded-cascode 540. The dump ends of the 2R resistors are tied to the node E of the dummy single-ended folded-cascode bias circuit 950 matched to the two branches of the folded-cascode and biased by the same voltage $V_{FC}$ as the output transistors $T_{FC3}$ and $T_{FC4}$. As a result, there is no net DC current flowing through the resistor networks 1320 and 1330.

The switches are controlled by the control signals $C_0$ to $C_n$. There should only be one control signal $C_k$(k=0, 1, . . . , n) active at a time. One possible way of generating the $C_0$ to $C_n$ control signals is by decoding a digital control word.

If $C_k$ is active (high level in the case of an NMOS switching transistor) and all the other control signals are inactive, then the global transconductance of the circuit operates according to rules (21), (22), and (23) above.

Figure 15:
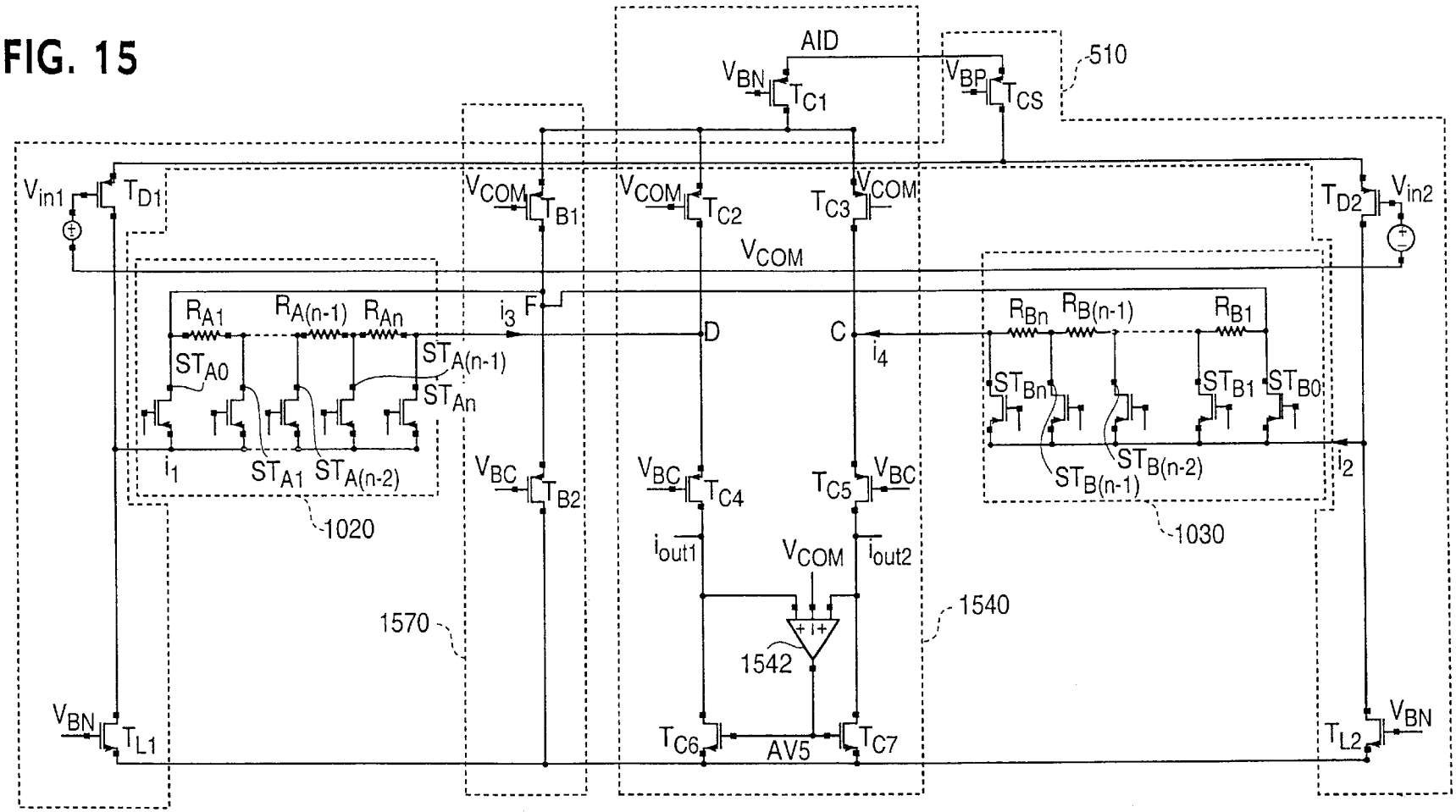
FIG. 15 is a circuit diagram showing an implementation of a regular cascode transconductor with intermediary resistor networks having switchable transconductance, according to a eighth preferred embodiment of the present invention.

FIG. 15 is a circuit diagram showing an implementation of a regular cascode transconductor with intermediary resistor networks having switchable transconductance, according to a sixth preferred embodiment of the present invention. The principle implemented in FIG. 11 for a transconductor followed by a folded-cascode is applied in the circuit of FIG. 15 to a transconductor followed by a regular cascode. The circuit has an input transconductor 510 followed by first and second resistor networks 1020 and 1030, a cascode current follower 1540 and a bias voltage generator 1570.

The cascode current follower 1540 includes first through sixth cascode transistors $T_{C1}$ to $T_{C6}$ and a subtracter/amplifier 1542. The bias voltage generator 1570 includes first and second bias transistors $T_{B1}$ and $T_{B2}$.

The bias voltages $V_{BP}$, $V_{BN}$ for the entire circuit are preferably established by a circuit that allows the output DC current of the input transconductor to be substantially zero. As a result, the voltages at nodes C, D, and F are equal.

$$V_C=V_D=V_F \tag{24}$$

The output currents of the transconductor 510 ($i_1$ and $i_2$) are scaled by the resistor networks 1020 and 1030 in a manner similar to that described for the circuit of FIG. 11. The scaled currents $i_3$ and $i_4$ enter the low impedance of the cascode block 1540.

The scaled currents $i_3$ and $i_4$ are transmitted to the high impedance outputs $i_{out1}$ and $i_{out2}$, respectively. The effect of the current dividers (resistor networks 1020 and 1030) on the overall transconductance is described by equations (13) and (14) above.

In addition, the circuits presented in FIG. 10 and FIG. 13 can also be applied to a cascode transconductor circuit as well as a folded-cascode circuit.

In alternate embodiments, if the input impedance of the cascode or folded-cascode is low enough, it is possible to attach several resistor networks in parallel onto the same inputs.

Furthermore, these techniques are equally applicable to other technologies, such as BiCMOS implementations.

The present invention has been described by way of a specific exemplary embodiment, and the many features and advantages of the present invention are apparent from the written description. Thus, it is intended that the appended claims cover all such features and advantages of the invention. Further, since numerous modifications, and changes will readily occur to those skilled in the art, it is not desired to limit the invention to the exact construction and operation ad illustrated and described. Hence, all suitable modifications and equivalent s may be resorted to as falling within the scope of the invention.

What is claimed is:

1. A cascode transconductor circuit, comprising:

a transconductor receiving first and second input voltages, and outputting first and second internal currents;

a first resistor connected between first and third nodes;

a second resistor connected between the first node and a fifth node, wherein the first and second resistors form a first resistive divider that receives the first internal current at the first node, and generates a third internal current at the third node;

a third resistor connected between second and fourth nodes;

a fourth resistor connected between the second node and the fifth node, wherein the third and fourth resistors form a second resistive divider that receives the second internal current at a second node, and generates a fourth internal current at a fourth node;

a cascode circuit receiving the third and fourth internal currents and supplying first and second output currents; and a dummy cascode connected to the fifth node.

2. A cascode transconductor circuit, as recited in claim 1, wherein the cascode circuit is a folded-cascode and the dummy cascode is a dummy folded-cascode that is a single-ended low-impedance input folded-cascode.

3. A cascode transconductor circuit, comprising:

a transconductor receiving first and second input voltages, and outputting first and second internal currents;

a first resistor network receiving the first internal current at a first node, and generating a third internal current at a third node;

a second resistor network receiving the second internal current at a second node, and generating a fourth internal current at a fourth node;

a cascode circuit receiving the third and fourth internal currents and supplying first and second output currents; and a dummy cascode coupled to the first and second resistor networks.

4. A cascode transconductor circuit, as recited in claim 3, wherein the cascode circuit is a folded-cascode and the dummy cascode is a dummy folded-cascode.

5. A cascode transconductor circuit, as recited in claim 3, wherein the cascode circuit is a regular cascode and the dummy cascode is a dummy regular cascode.

6. A cascode transconductor circuit, as recited in claim 3, wherein the first resistor network comprises p first resistors connected in series between the third node and a fifth node; and (p+1) first switches, each connected between the first node and an end of one of the p first resistors, such that each first resistor is connected to two of the (p+1) first switches; and wherein the second resistor network comprises second resistors connected in series between the fourth node and the fifth node; and (p+1) second switches, each connected between the second node and an end of one of the p second resistors, such that each second resistor is connected to two of the (p+1) second switches, where p is an integer greater than 1.

7. A cascode transconductor circuit, as recited in claim 6, wherein the fifth node is connected to an AC ground voltage through the dummy cascode.

8. A cascode transconductor circuit, as recited in claim 6, wherein the cascode circuit comprises a folded-cascode and the dummy cascode is a dummy folded-cascode, and wherein the fifth node is connected to the dummy folded-cascode.

9. A cascode transconductor circuit, as recited in claim 8, wherein the dummy folded-cascode is a single low-impedance input folded-cascode.

10. A cascode transconductor circuit, as recited in claim 6, wherein during operation, only one of the first switches and one of the second switches are closed at a given time.

11. A cascode transconductor circuit, as recited in claim 6, wherein the first and second switches each comprise respective transistors controlled by one of a plurality of control signals.

12. A cascode transconductor circuit, as recited in claim 6, wherein the first and second resistors each comprise respective transistors controlled by a bias voltage.

13. A cascode transconductor circuit, as recited in claim 6, wherein an $i^{th}$ first resistor and an $i^{th}$ second resistor have a same value, where i is an integer between 1 and p.

14. A cascode transconductor circuit, comprising:

a transconductor receiving first and second input voltages, and outputting first and second internal currents;

a first programmable R-nR network receiving the first internal current at a first node, and generating a third internal current at a third node;

a second programmable R-nR network receiving the second internal current at a second node, and generating a fourth internal current at a fourth node; and a cascode circuit receiving the third and fourth internal currents and supplying first and second output currents.

15. A cascode transconductor circuit, as recited in claim 14, wherein the cascode circuit is a folded-cascode.

16. A cascode transconductor circuit, as recited in claim 14, wherein the cascode circuit is a regular cascode.

17. A cascode transconductor circuit, as recited in claim 14, wherein the first programmable R-nR network comprises first resistors connected in series between the third node and a fifth node;

(p−1) second resistors, each connected between the fifth node and a connection between two of the p first resistors, such that each meeting of two of the p first resistors is connected to one of the (p−1) second resistors; and (p+1) first switches, each connected between the first node and an end of one of the p first resistors, such that each first resistor is connected to two of the (p+1) first switches; and wherein the second programmable R-nR network comprises third resistors connected in series between the fourth node and the fifth node;

(p−1) fourth resistors, each connected between the fifth node and a connection between two of the p third resistors, such that each meeting of two of the p third resistors is connected to one of the (p−1) fourth resistors; and (p+1) second switches, each connected between the second node and an end of one of the p third resistors, such that each p third resistor is connected to two of the (p+1) second switches.

18. A cascode transconductor circuit, as recited in claim 17, wherein the fifth node is connected to an AC ground voltage.

19. A cascode transconductor circuit, as recited in claim 17, further comprising a dummy folded-cascode, wherein the cascode circuit is a folded-cascode and the fifth node is connected to an AC ground voltage through the dummy folded-cascode.

20. A cascode transconductor circuit, as recited in claim 19, wherein the dummy folded-cascode is a single low-impedance input folded-cascode.

21. A cascode transconductor circuit, as recited in claim 17, wherein during operation, only one of the first switches and one of the second switches are closed at a given time.

22. A cascode transconductor circuit, as recited in claim 17, wherein each of the first and second switches comprises respective transistors controlled by one of a plurality of control signals.

23. A cascode transconductor circuit, as recited in claim 17, wherein $2^{nd}$ through $(p-1)^{th}$ first resistors and $2^{nd}$ through $(p-1)^{th}$ third resistors all have a first resistance value, wherein $1^{st}$ and $p^{th}$ first resistors, $1^{st}$ and $p^{th}$ third resistors, a (p−1) second resistor, and a (p−1) fourth resistor all have a second resistance value substantially equal to an integral multiple of the first resistance value.

24. A cascode transconductor circuit, as recited in claim 23, wherein the second resistance value is twice the first resistance value.

25. A cascode transconductor circuit, as recited in claim 6, wherein the dummy cascode is coupled to the fifth node.

26. A cascode transconductor circuit, as recited in claim 14, wherein the first and second programmable R-nR networks are coupled to an AC ground voltage.

27. A cascode transconductor circuit, as recited in claim 14, wherein n=2.

* * * * *